US007337481B2

(12) United States Patent
Gilbert

(10) Patent No.: US 7,337,481 B2
(45) Date of Patent: Mar. 4, 2008

(54) APPARATUS FOR SECURING BEDDING

(75) Inventor: Nicole Gilbert, Charlotte, NC (US)

(73) Assignee: Baby Love LLC, Charlotte, NC (US)

( * ) Notice: Subject to any disclaimer, the term of this patent is extended or adjusted under 35 U.S.C. 154(b) by 7 days.

(21) Appl. No.: 11/462,512

(22) Filed: Aug. 4, 2006

(65) Prior Publication Data

US 2008/0028524 A1 Feb. 7, 2008

(51) Int. Cl.
*A47G 9/04* (2006.01)

(52) U.S. Cl. ..... 5/494; 5/498; 5/655; 24/72.5; 24/303

(58) Field of Classification Search ..... 5/494, 5/496, 498, 482, 504.1, 658, 655; 24/72.5, 24/303; 128/872
See application file for complete search history.

(56) References Cited

U.S. PATENT DOCUMENTS

| | | | | |
|---|---|---|---|---|
| 467,980 | A | 2/1892 | Levy | |
| 2,284,448 | A * | 5/1942 | Reinholz | 128/872 |
| 2,826,795 | A | 3/1958 | Blaine | |
| 3,045,310 | A * | 7/1962 | Velinsky | 24/462 |
| 3,143,747 | A | 8/1964 | McSorley et al. | |
| 6,301,729 | B1 | 10/2001 | Hall | |
| 6,684,437 | B2 | 2/2004 | Koenig | |
| 6,834,405 | B1 * | 12/2004 | Hillstead | 5/655 |
| 6,857,146 | B2 | 2/2005 | Landry | |
| 6,857,430 | B2 | 2/2005 | Morris | |
| 6,957,455 | B1 | 10/2005 | Misson | |
| 6,990,697 | B1 | 1/2006 | Clute | |

OTHER PUBLICATIONS

Choose Safety Choose a Safe T Sleep, http://www.safetsleep.com, downloaded on Jun. 7, 2005.

* cited by examiner

*Primary Examiner*—Alexander Grosz
(74) *Attorney, Agent, or Firm*—Summa, Allan & Addition, P.A.

(57) ABSTRACT

The present invention is directed to an apparatus suitable for securing bedding. The apparatus of the invention includes at least two complimentary generally U-shaped components having mating surfaces adapted to cooperate with one another to secure bedding placed therebetween and to form a pocket of the bedding, which can be suitable for receiving an infant. The apparatus of the invention further includes a mechanism for releasably securing the lower member and the upper member to each other, which can include a plurality of magnets having opposing polarities positioned along the mating surfaces of the U-shaped members to mate with a corresponding magnet.

21 Claims, 2 Drawing Sheets

APPARATUS FOR SECURING BEDDING

FIELD OF THE INVENTION

The present invention relates to an apparatus for securing bedding.

BACKGROUND OF THE INVENTION

A variety of infant blankets and coverings have been developed to help keep an infant warm while sleeping. Many such coverings can include mechanisms for attaching a sheet or blanket to a crib mattress and/or a crib bumper pad. Various other techniques have focused on infant jackets and fitted garments, which are attached to crib sheets and blankets.

With increased knowledge about infant sleeping patterns and sleeping safety, concern for infant warmth is now shared with a concern for infant comfort and safety. Some infants frequently change positions while sleeping so it can be desirable to free the baby's sleeping environment of hazards while at the same securing the baby's sleeping position.

An additional consideration in the infant bedding design is Sudden Infant Death Syndrome (SIDS). SIDS is the term used to describe the sudden, unexplained death of a baby under one year of age. Researchers estimate that SIDS is the cause of about 2,500 infant deaths each year. Although scientific and medical research has uncovered factors which indicate a predisposition to the disorder (i.e., low birth weight, age of mothers), no specific cause has been uncovered. Moreover, there are varied theories put forth by the medical community as to the cause of SIDS. Some theories suggest a neurological disorder in the infants which intercepts the breathing functions while sleeping and leads to the infant's death by asphyxiation.

Reducing SIDS deaths has been a goal of the National Institute of Child Health and Human Development ("NICHD") since it was founded. In 1974, Congress passed the Sudden Infant Death Syndrome Act (Public Law 93-270), which placed the NICHD at the forefront of SIDS research. This Act also charged the NICHD with providing information to the people of the United States about SIDS and ways to reduce the risk of SIDS.

In 1991, as a result of NICHD-supported research, the American Academy of Pediatrics (AAP) began recommending that babies be placed on their backs to sleep, at naptime and at bedtime, to help reduce the risk of SIDS. In 1994, the NICHD joined the AAP and other partners in starting the "Back to Sleep" campaign, an effort to educate the public about reducing the risk of SIDS by placing babies to sleep on their backs. Since that time, the number of SIDS deaths has dropped by 50 percent.

Other recommendations include placing the baby on a firm mattress, such as in a safety-approved crib. Research has shown that placing a baby to sleep on soft mattresses, sofas, sofa cushions, waterbeds, sheepskins, or other soft surfaces can increase the risk of SIDS. Yet another recommendation includes removing soft, fluffy bedding and stuffed toys from the baby's sleep area. Still further, the NICHD recommends making sure the baby's head and face stay uncovered during sleep. This can include keeping blankets and other coverings away from a baby's mouth and nose, for example, by tucking the blanket in around the bottom of the crib mattress. While useful, merely tucking bedding around a crib mattress may not be sufficient to secure the bedding, especially for active babies that move, kick, and otherwise disrupt the position of bedding placed in the crib.

BRIEF SUMMARY OF THE INVENTION

The present invention is an apparatus useful for securing bedding, such as a sheet or a blanket. The apparatus of the invention includes complimentary fitting generally U-shaped upper and lower members, each having a top side and a bottom side. The top side of the lower member and the bottom side of the upper member are adapted to cooperate with one another to secure bedding placed therebetween and to form a pocket of bedding suitable for receiving an infant.

The apparatus of the invention further includes a mechanism for releasably securing the lower member and the upper member to each other. In certain embodiments of the invention, the mechanism for releasably securing the upper and lower members to one another includes a plurality of magnets. At least a first plurality of magnets having a first polarity can be positioned along the top side of the lower member, and at least a second plurality of magnets having a second polarity opposite the first polarity can be positioned along the bottom side of the upper member. In this embodiment of the invention, each of the magnets along the top side of the lower member can be positioned to mate with a corresponding magnet along the bottom side of the upper member for releasably securing the lower member and the upper member to each other.

In certain embodiments of the invention, at least the bottom side of the upper member is defined by a plurality of intersecting transverse ribs and longitudinal ribs. In this embodiment of the invention, the transverse ribs can extend downwardly from the bottom side of the upper member and can have different lengths to define a generally concave shape. Also in this embodiment of the invention, at least a portion of the top side of the lower member can have a generally convex shape so that the top side of the lower member and the lower side of the upper member fit together in a complementary manner.

The apparatus of the invention can further include an anchor strap to anchor the lower member to a mattress. The anchor strap can include a first end that includes a releasable fastener to releasably attach the strap to a portion of the lower member. The apparatus can further include a handle for separating the upper and lower members, which handle can be integrally formed along a portion of the top side of the upper member.

In use, the generally U-shaped lower member can be placed directly onto a mattress, and a fitted sheet can be placed onto the mattress to cover both the mattress and the lower member. Alternatively, the lower member can be placed on top of a bedding layer that the infant or child will lie upon. After placing additional bedding (e.g., a sheet or a blanket) over the bottom member, the complimentary upper member may be secured to the bottom member over the bedding to clamp the bedding in place and form a U-shaped pocket.

Various mechanisms of the apparatus of the invention can prevent movement of the bedding and/or the clamp. The upper and lower members can be contoured such that the pieces will only fit together when they are correctly oriented with respect to each other. A plurality of magnets recessed in the upper and lower members further secure the members together. Alternating ribs along the interface between the upper and lower pieces can serve to "bite" the bedding and further discourage movement of the clamped bedding. The lower member can further include an anchor strap that may be routed underneath the mattress and buckled, thus preventing movement of the apparatus.

The bedding clamp of the invention can prevent bedding from shifting and covering the head of an infant or small child. In addition, the U-shaped pocket can prevent sideways and downward movement of the child. The invention can accordingly minimize the risk of suffocation. In addition, although the exact cause of Sudden Infant Death Syndrome (SIDS) is unknown, soft bedding may be a contributor. Securing infant bedding in accordance with the present invention may also reduce the risk of SIDS as well.

BRIEF DESCRIPTION OF THE DRAWINGS

Figure 1:
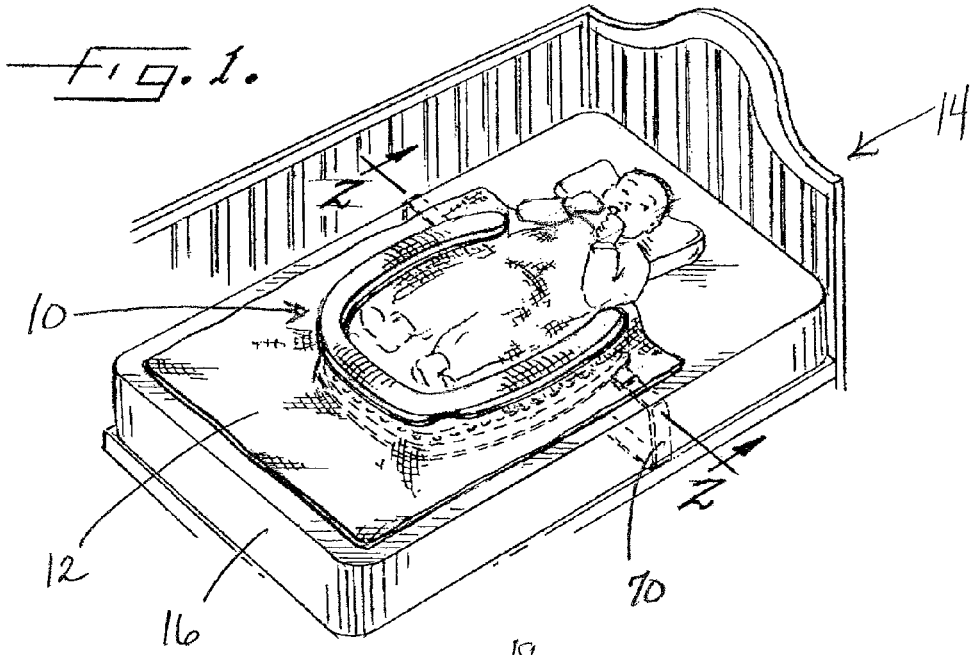
Figure 2:
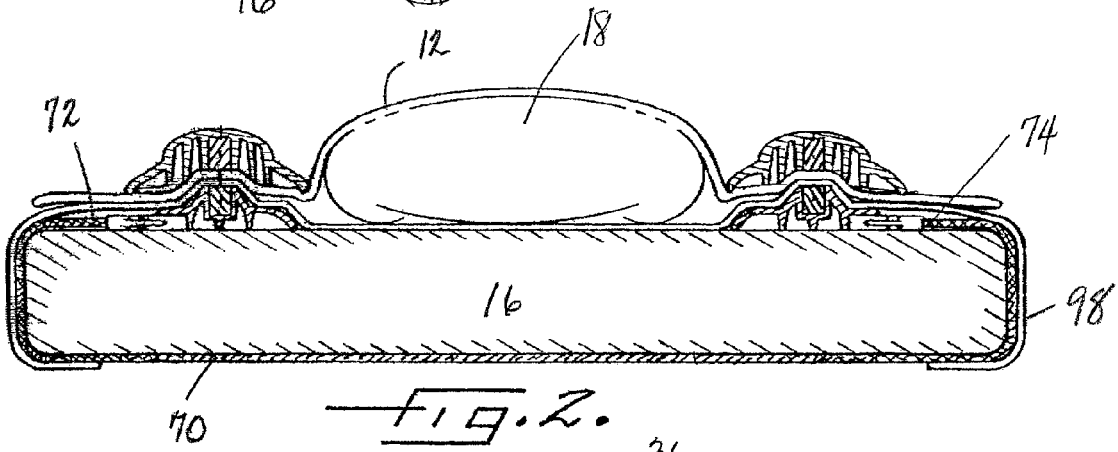
Figure 3:
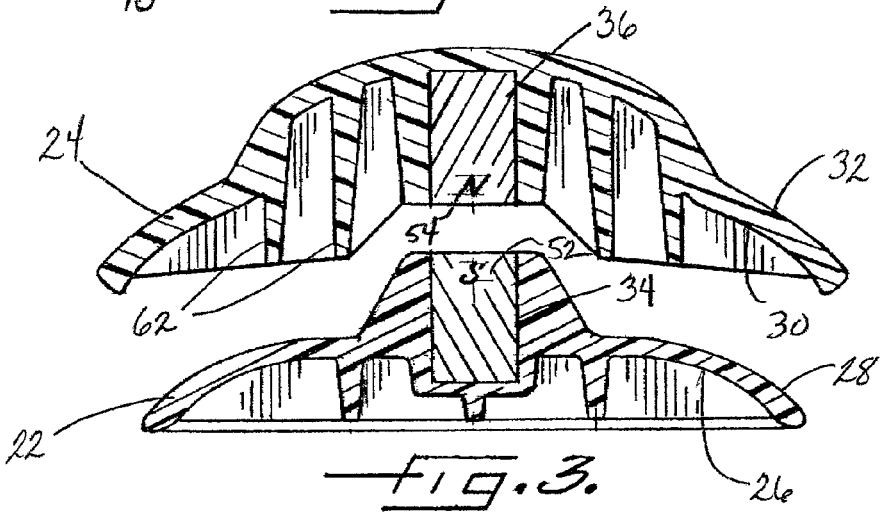
Figure 4:
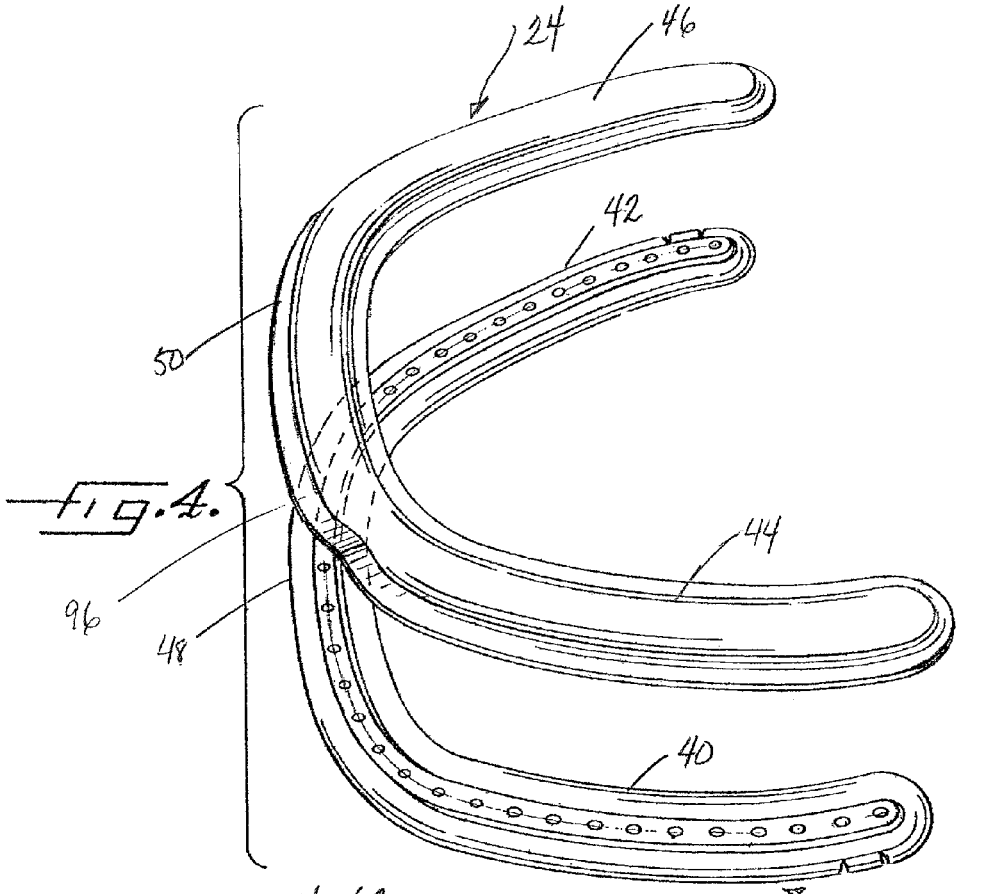
Figure 5:
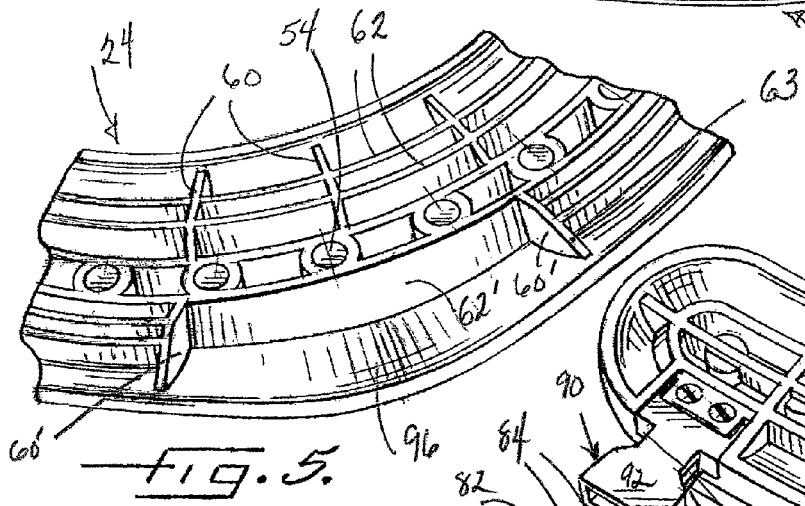
Figure 6:
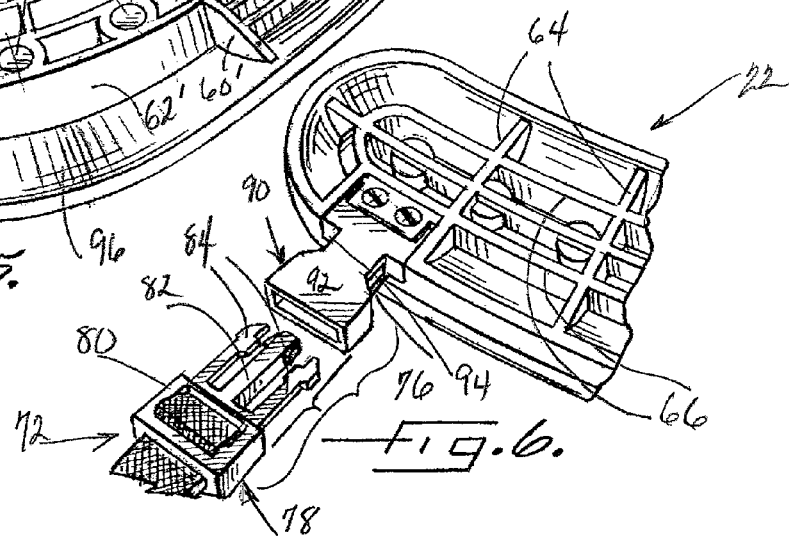

Having thus described the invention in general terms, reference will now be made to the accompanying drawings, which are not necessarily drawn to scale, and in which:

FIG. 1 is a fragmented environmental perspective view of an exemplary embodiment of the apparatus of the invention positioned around a mattress and securing bedding in a manner to form a pocket of the bedding and the mattress within which an infant is secured;

FIG. 2 is a cross sectional view of the apparatus of the invention taken along line 2-2 of FIG. 1;

FIG. 3 is a greatly enlarged view of a portion of the apparatus of FIG. 2;

FIG. 4 is a top perspective view of the apparatus of the invention and illustrates an exemplary embodiment including upper and lower complimentary generally U-shaped members;

FIG. 5 is a perspective view of a bottom side of a portion of the generally U-shaped upper member of FIG. 4 and illustrates an exemplary handle for ease of releasing the respective components of the apparatus from one another; and FIG. 6 is a perspective view of a bottom side of a portion of the generally U-shaped lower member of FIG. 4 and illustrates an exemplary anchor strap for attaching the apparatus of the invention to a mattress.

DETAILED DESCRIPTION OF THE INVENTION

The present invention now will be described more fully hereinafter in the following detailed description of the invention, in which some, but not all embodiments of the invention are described. Indeed, this invention may be embodied in many different forms and should not be construed as limited to the embodiments set forth herein; rather, these embodiments are provided so that this disclosure will satisfy applicable legal requirements. Like numbers refer to like elements throughout.

As used in the specification, and in the appended claims, the singular forms "a", "an", and "the" include plural referents unless the context clearly dictates otherwise.

It will be understood that when an element such as a component, layer, substrate or the like is referred to as being "on" or extending "onto" another element, it can be directly on or extend directly onto the other element or intervening elements may also be present. In contrast, when an element is referred to as being "directly surface to surface," "directly on" or extending "directly onto" another element, there are no intervening elements present. Similarly, it will be understood that when an element such as a component, layer, substrate or the like is referred to as being "attached" or "mounted" to another element, it can be directly attached to the other element or intervening elements may also be present. In contrast, when an element is referred to as being "directly attached" or "directly mounted" to another element, there are no intervening elements present.

It will be understood that relative terms, such as "lower" or "bottom" and "upper" or "top," may be used herein to describe one element's relationship to another element as illustrated in the Figures. Similarly, relative terms such as "underlying," "underneath," "below," and "beneath" may also be used to describe one element's relationship to another element as illustrated in the Figures. It will be understood that relative terms are intended to encompass different orientations of the articles in addition to the orientation depicted in the Figures. Furthermore, it will be understood that such terms can be used to describe the relative positions of element(s) to one another, and for example, the terms can refer to an element that is "beneath" or "underlying" another element, with or without other intervening elements therebetween.

Embodiments of the present invention are described herein with reference to various perspectives thereof, including cross-sectional and perspective illustrations that are schematic illustrations of idealized embodiments of the present invention. As such, variations from the shapes of the illustrations as a result, for example, of manufacturing techniques are to be expected. Thus, embodiments of the present invention should not be construed as limited to the particular shapes of components illustrated herein but are to include deviations in shapes that result, for example, from manufacturing and other variances. The articles and their respective components illustrated in the figures are schematic in nature and their shapes are not intended to illustrate the precise shape of a component of an article and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

One aspect of the present invention is directed to an apparatus designated generally in FIG. 1 as 10, which can be useful as a mechanism or clamp for securing bedding 12, such as a flat or top sheet, comforter, or blanket as illustrated. Apparatus 10 of the invention can be useful in various environments, including a crib 14 with an infant sized mattress 16, such as illustrated in FIG. 1. The present invention is not so limited, however, and apparatus 10 can also be useful in various other environments, such as but not limited to various sized mattresses for babies, toddlers and adults for cribs, bassinets, incubators, playpens, portable cribs, toddler beds, adult sized beds, and the like.

As illustrated in FIG. 1 and as discussed in more detail herein, in use, the apparatus 10 of the present invention can secure bedding 12 and form a pocket, designated generally in FIG. 2 as 18, of the bedding 12 and the mattress 16. The pocket 18 is suitable for receiving and securing an infant placed therein, for example, as illustrated in FIG. 1, in a manner (on its back) currently recommended for sleep. The apparatus 10 of the invention can also secure bedding to help prevent the bedding from covering the infant's head and face during sleep. Still further, the apparatus 10 of the invention can help secure bedding for active babies that move, kick, and otherwise disrupt the position of bedding placed in the crib. By securing an infant in this manner, there is a lower chance that the infant will roll itself over or extract itself from the bedding 12. As best seen in FIG. 1, the apparatus is of a sufficient size to surround a substantial portion of the lower portion of the body of a user resting on a mattress.

Turning to FIGS. 3 and 4, the apparatus 10 of the invention includes a generally U-shaped lower member 22 having a bottom side or surface 26 and a top side or surface 28. The apparatus 10 of the invention further includes a complimentary generally U-shaped upper member 24 having a bottom side or surface 30 and a top or surface side 32. As illustrated in FIG. 4, each of the lower member 22 and the upper member 24 can include a pair of similarly sized generally horizontally extending side arms 40, 42 and 44, 46, and a curved end 48 and 50, respectively, extending between and connecting the side arms.

The top side 28 of lower member 22 and the bottom side 30 of upper member 24 are adapted to cooperate with one another to secure bedding, such as bedding 12, placed therebetween and to thereby form a pocket of bedding suitable for receiving an infant. Stated differently, the top side 28 of lower member 22 and the bottom side 30 of the upper member 24 can be complimentarily shaped with respect to one another so to align the top and lower members 22, 24 when secured to one another.

As a non-limiting example, as illustrated in FIG. 3, at least a portion of the top side 26 of the lower member 22 can have a generally convex shape. In this embodiment of the invention, at least a portion of the bottom side 30 of the upper member 24 can have a generally concave shape. In this manner, the top side 26 of the lower member 24 and the lower side 30 of the upper member 24 can fit together in a complementary manner.

As illustrated in FIGS. 3 and 5, the bottom side 30 of the upper member 24 can be defined by a plurality of intersecting transverse ribs 60 and longitudinal ribs 62. The ribs can have different functionalities useful in the present invention. For example, the illustrated rib structure can impart a desired shape to the upper member 24, including the surface configuration of the lower side 30 of upper member 24. As a non-limiting example, as illustrated in FIGS. 3 and 5, the longitudinal ribs 62 can extend downwardly from the bottom side 30 of the upper member 24 and can have different lengths to define a generally concave shape.

Transverse ribs 60 and longitudinal ribs 62 can further impart structural integrity to the upper member 24. Transverse ribs 60 and longitudinal ribs 62 can further provide a gripping mechanism or biting means for "biting" into bedding such as a blanket placed between the mating surfaces of upper and lower members 22 and 24 to further secure and prevent slippage of the bedding.

As illustrated in FIGS. 3 and 6, the bottom side 26 of lower member 22 can be defined by a plurality of intersecting transverse ribs 64 and longitudinal ribs 66. Transverse ribs 64 and longitudinal ribs 66 can generally impart structural integrity to the lower member 22.

Complimentary lower and upper members 22, 24 of apparatus 10 of the invention can be formed of any material useful to impart sufficient stability and structure to the device. The apparatus may be formed of a material capable of being molded to form the desired shape and further is suitable for use in close proximity to an infant or other user. Exemplary materials include polymeric materials, such as but not limited to polyolefins, including polypropylene and polyethylene; polyesters, including polyethylene terephthalate; and the like, as well as mixtures thereof. Polyolefins can be particularly useful for the production of devices using injection molding techniques as known in the art.

The apparatus 10 of the present invention further includes a mechanism for releasably securing the lower member 22 and the upper member 24 to each other. As illustrated, advantageously the mechanism for releasably securing the upper and lower members to one another includes a plurality of magnets. In this embodiment of the invention, the magnets can include a first plurality of magnets, designated in the figures as 52, having a first polarity positioned along the top side 28 of the lower member 22. Also in this embodiment of the invention, the magnets can further include a second plurality of magnets 54 having a second polarity opposite the first polarity of magnets 52, which are positioned along the bottom side 30 of upper member 24.

As illustrated for example in FIG. 3, each of the magnets 52 along the top side 28 of the lower member 22 is positioned to mate with a corresponding magnet 54 along the bottom side 30 of the upper member 24. In this manner, each respective magnet 52, 54 can magnetically releasably secure lower and upper members 22, 24 to one another when the members are placed together so as to align magnets 52 and 54 as illustrated. Advantageously, the first plurality of magnets 52 are substantially equally spaced apart from each other along the top side 28 of the side arms 40 and 42 and curved end 48 of the lower member 22, and the second plurality of magnets 54 are substantially equally spaced apart from each other along the bottom side 30 of the side arms 44 and 46 and curved end 50 of the upper member 24.

The plurality of magnets 52, 54 can be placed in the apparatus 10 using any suitable mechanism for securing the magnets. For example, as illustrated in FIG. 3, the top side 28 of lower member 22 can include a plurality of spaced apart recesses 34, each of which can be configured to receive a magnet 52. In this embodiment of the invention, as also illustrated in FIG. 3, the bottom side 30 of upper member 24 can also include a plurality of spaced apart recesses 36, each of which can also be configured to receive a magnet 54. Also in this embodiment of the invention, advantageously magnets 52, 54 have a generally conical shape with opposing ends, wherein each of the magnets can be placed within each respective corresponding recess 34, 36 so that one of the opposing ends is substantially flush with the outer surface of the lower or upper member.

To assure that apparatus 10 will not shift or otherwise disengage from the bed, as illustrated in FIGS. 1 and 2, the apparatus 10 can further include an anchor strap 70. Turning to FIGS. 2 and 6, anchor strap 70 can have a first end 72 and an opposing end 74. The first end 72 of the anchor strap 70 can be releasably attached to a portion of the lower member 22, and in particular to a terminal portion of one of the pair of arms 40 or 42 of lower member 22. The skilled artisan will appreciate based on a reading of this application that opposing end 74 of the anchor strap 70 can also be releasably attached to a terminal portion of the other of the pair of arms 40 or 42 of the lower member 22 in a manner similar to that described herein with regard to end 72. Alternatively, the opposing end 74 of the anchor strap 70 can be permanently secured to a terminal portion of the other of the pairs of arms 40 or 42 of the lower member.

The apparatus of the invention can further include a releasable fastener system such as releasable fastener 76 illustrated in FIG. 6. The releasable fastener system 76 can include a male component 78 secured to end 72 of strap 70. The male component 78 includes a body 80 having an alignment arm 82, flanked by a pair or flexible gripping arms 84, extending from one of its ends. At the other end of body 80 is a slot through which is run strap 70. A post (not shown) joins opposite ends of the slot together, and the anchor strap 70 can be folded over the post in a well-known manner so that the usable length thereof can be selectively varied. To prevent male component 78 from detaching from anchor strap 70, the free end 72 of anchor strap 70 can be folded back upon itself and optionally sewn in place to form stops incapable of passing through the slot and past the post.

FIG. 6 further illustrates a female component 90 of the releasable fastener system 76 affixed to a terminal portion of one of the arms 40, 42 of the lower member 22 for receiving the male component 78 of the releasable fastener system 76. The female component 90 can be suitably secured to arm 40 or 42 using any suitable means such as one or more screws as illustrated. Female component 90 can include a tubular body 92 having recesses 94 in its opposite sides open to its interior for releasably receiving the gripping arms 84 of male component 78 inserted into the open end of tubular body 92.

The apparatus of the invention can further include an integrated handle to assist a user in separating the lower and upper members 22, 24 from one another. For example, as illustrated in FIGS. 4 and 5, the apparatus can include an integral handle 96 formed along a portion of upper member 24. The handle 96 can be shaped and sized in a manner selected to provide a suitable grip for a user. As a non-limiting example, handle 96 can include a curved portion framed by opposing transverse ribs 60' having angled outer edges 63 and longitudinal rib 62'.

The apparatus of the invention can further include a friction enhancing material on at least a portion of the bottom side 26 of the lower member 22, for example, along an end edge of one or more transverse or longitudinal ribs 64, 66. The friction enhancing material can further assist in securing the apparatus to a mattress and/or bedding and minimize or prevent substantial slippage of the apparatus in use. Exemplary non-limiting friction enhancing materials can include any of the types of materials having useful anti-slip properties, such as suction cups, rubber grips, and the like, as well as combination thereof. The downwardly extending ribs 64 and 66 can also contribute to the anti-slip properties of the bottom side of lower member 22.

The apparatus 10 of the invention can be used to secure bedding as follows. The generally U-shaped lower member 22 can be placed directly onto a mattress 16, and a fitted sheet, such as fitted sheet 98 in FIG. 2, can be placed onto the mattress 16 to cover both the mattress 16 and the lower member 22. Alternatively, the lower member 22 can be placed on top of one or more bedding layers, such as fitted sheet 98, that the infant or child will lie upon. After placing additional bedding (e.g., a sheet or a blanket 12) over the bottom member 22, the complimentary upper member 24 may be secured to the bottom member over the bedding 12 to clamp the bedding 12 in place and form a U-shaped pocket 18.

Many modifications and other embodiments of the invention will come to mind to one skilled in the art to which this invention pertains having the benefit of the teachings presented in the foregoing descriptions. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation, the scope of the invention being defined in the claims.

That which is claimed is:

1. An apparatus for securing bedding, comprising:

a generally U-shaped lower member having a bottom side and a top side;

a complimentary generally U-shaped upper member having a bottom side and a top side; and securing means for releasably securing the lower member and the upper member to each other, the top side of said lower member and the bottom side of said upper member being adapted to cooperate with one another to secure bedding placed therebetween and to form a pocket of bedding suitable to surround a substantial portion of the lower portion of the body of a user resting on a mattress.

2. The apparatus of claim 1, wherein said securing means comprises a plurality of magnets.

3. The apparatus of claim 2, wherein said plurality of magnets comprises:

a first plurality of magnets having a first polarity along the top side of said lower member; and a second plurality of magnets having a second polarity opposite the first polarity along the bottom side of said upper member.

4. The apparatus of claim 3, wherein each of said magnets along the top side of said lower member is positioned to mate with a corresponding magnet along the bottom side of said upper member for releasably securing the lower member and the upper member to each other.

5. The apparatus of claim 4, wherein:

each of said lower member and said upper member comprises a pair of similarly sized generally horizontally extending side arms and a curved end extending between and connecting said side arms;

said first plurality of magnets are substantially equally spaced apart from each other along the top side of the side arms and curved end of the lower member; and said second plurality of magnets are substantially equally spaced apart from each other along the bottom side of the side arms and curved end of the upper member.

6. The apparatus of claim 5, wherein:

the top side of said lower member comprises a plurality of recesses comprising a magnet having said first polarity; and the bottom side of said upper member comprises a plurality of complimentary recesses comprising a magnet having said second polarity.

7. The apparatus of claim 6, wherein each of said magnets has a generally conical shape with opposing ends placed within a corresponding recess so that one of said opposing ends is substantially flush with the outer surface of said lower or said upper member.

8. The apparatus of claim 1, wherein said top side of said lower member and said bottom side of said upper member are complimentarily shaped to align said top member and said lower member when secured to each other.

9. The apparatus of claim 8, wherein at least a portion of said top side of said lower member has a generally convex shape and at least a portion of said bottom side of said upper member has a generally concave shape such that the top side of the lower member and the lower side of said upper member fit together in a complementary manner.

10. The apparatus of claim 9, wherein the bottom side of said upper member is defined by a plurality of intersecting transverse and longitudinal ribs.

11. The apparatus of claim 10, wherein said transverse ribs comprise a plurality of ribs extending downwardly from the bottom side of said upper member having different lengths to define said generally concave shape.

12. The apparatus of claim 11, wherein said downwardly extending ribs provide a gripping mechanism to secure bedding material placed between the bottom side of the upper member and the top side of the lower member when said upper member and said lower member are secured to one another via said securing means.

13. The apparatus of claim 9, wherein the bottom side of said lower member is defined by a plurality of intersecting transverse and longitudinal ribs.

14. The apparatus of claim 1, further comprising an anchor strap comprising a first end releasably attachable to a portion of said lower member for anchoring said lower member to a mattress.

15. The apparatus of claim 14, wherein said anchor strap further comprises a second end releasably attachable to a different portion of said lower member.

16. The apparatus of claim 14, wherein said anchor strap further comprises a second end fixed to a different portion of said lower member.

17. The apparatus of claim 14, wherein said apparatus further comprises a releasable fastener comprising a male component secured to the first end of the anchor strap and a female component for receiving the male component fixed to a portion of an arm of the lower member.

18. The apparatus of claim 1, comprising a handle along said upper member for separating said upper and lower members.

19. The apparatus of claim 18, wherein said handle is integrally formed along a portion of the top side of the upper member.

20. The apparatus of claim 1, comprising friction enhancing material on the bottom side of said lower member.

21. A method for securing bedding, comprising:

placing a generally U-shaped lower member on a sleeping surface of a mattress;

drawing at least one article of bedding over the lower member; and releasably securing a complimentary generally U-shaped upper member to the lower member, thereby clamping the at least one article of bedding in place to form a U-shaped pocket, the U-shaped members being of a size adapted to surround a substantial portion of the lower portion of the body of a user resting on the mattress.

* * * * *